US006978563B2

(12) United States Patent
Jung

(10) Patent No.: US 6,978,563 B2
(45) Date of Patent: Dec. 27, 2005

(54) APPARATUS FOR AUTOMATICALLY TURNING PAGE OF BOOK

(76) Inventor: Nam Su Jung, 8-555 Hongeun-Dong, Seodaemun-Gu, Seoul 120-100 (KR)

( * ) Notice: Subject to any disclaimer, the term of this patent is extended or adjusted under 35 U.S.C. 154(b) by 22 days.

(21) Appl. No.: 10/726,485

(22) Filed: Dec. 4, 2003

(65) Prior Publication Data

US 2004/0107612 A1 Jun. 10, 2004

(30) Foreign Application Priority Data

Dec. 5, 2002 (KR) ..... 10-2002-0076794

(51) Int. Cl.[7] ..... G10G 7/00; B42D 9/04
(52) U.S. Cl. ..... 40/343; 84/504
(58) Field of Search ..... 84/486, 487, 493, 84/503–505, 507; 40/343

(56) References Cited

U.S. PATENT DOCUMENTS 2,755,580 A * 7/1956 Justice ..... 40/531
2,886,806 A * 5/1959 Bush ..... 377/88
4,463,651 A * 8/1984 Hammer ..... 84/504
2003/0003429 A1 1/2003 Jung

FOREIGN PATENT DOCUMENTS

KR 2002-0050736 A 6/2002

* cited by examiner

*Primary Examiner*—Cassandra Davis
(74) *Attorney, Agent, or Firm*—Roylance, Abrams, Berdo & Goodman, LLP

(57) ABSTRACT

An apparatus for automatically turning a page of a book comprises a casing 10 on which a music book 5 can be placed in an opened state; a page holding means 40 which is installed within the casing 10 and holds a page 6 of the opened music book 5 to be turned and a turned page 7 thereof; a page turning means 50 which is installed within the casing 10 to turn a page of the opened music book; a driving member 60 for driving the page holding means 40 and the page turning means 50, a manipulation member 110 for manipulating operations of the driving member 60, and a control unit 130 for controlling the operations of the driving member 60 for turning a relevant page of the music book 5 placed on the casing 10, in response to signals from the manipulation portion 110.

15 Claims, 13 Drawing Sheets

APPARATUS FOR AUTOMATICALLY TURNING PAGE OF BOOK

BACKGROUND OF THE INVENTION

1. Field of the Invention

The present invention relates to an apparatus for automatically turning a page of a book, and more particularly, to an apparatus for automatically turning pages of a book or a music book one by one while a user reads the book, types or particularly, plays a musical instrument.

2. Description of the Prior Art

A conventional apparatus for automatically turning a page of a book is disclosed in Korean Patent Application No. 2001-81840 filed in the name of the present applicant. FIG. 1 is a perspective view of the conventional apparatus for automatically turning a page of a book, and FIG. 2 is an enlarged view of a major portion of FIG. 1. As shown in the figures, in the conventional apparatus 200, when a power switch 260 is manipulated in a state where a music book is kept open on a top surface of a casing 250, a geared motor 230 is operated.

Then, a guider 203 receives rotational force through gear units 202 and 205 and rotates in a forward direction to cause an actuating lever 255, which has a lower end hingedly secured on a pivoting shaft 201 and penetrates through a guide slot 204 formed in the guider 203, to pivot upwardly. At this time, since the guide slot 204 of the guider 203 is formed to make an acute angle downwardly with respect to a horizontal direction, the actuating lever 255 escapes from the casing 250 and moves in an aft direction while pivoting upwardly. The actuating lever 255 is guided by a helical depressing piece 260 so that a pressing piece 256 at an upper end of the actuating lever 255 remains in close contact with a page to be turned.

Further, the rotational force of the gear units 202 and 205 causes a pressure contact piece 270 protruding beyond the top surface of the casing 250 to move in the aft direction and to press down a lower end of the page to be turned. That is, the rotational force of the gear unit 205 is also transmitted to a crankshaft 271. At this time, the crankshaft 271 causes a stopper 273 to be moved against the tension of an elastic member 272, so that a hook piece 274 of the stopper 273 is caught in a fixing piece. Since the stopper 273 is connected to the pressure contact piece 270 via a wire 275, the movement of the stopper 273 causes the pressure contact piece 270 to press down the lower end of the page to be turned.

Meanwhile, in the page to be turned which is about to be moved upwardly with the pressing piece 256 brought into close contact therewith, a portion of the page inside of the portion pressed by the pressure contact piece 270 bulges in the fore direction. Therefore, the actuating lever 255 pivoting upwardly pushes the lower end of the page to be turned and is then introduced to the back of the page. Thereafter, the actuating lever 255 pivots in the left direction along an arc, thereby turning the page to the left. At this time, the turned page is caught by a supporting piece 257 and thus is prevented from returning to the original position. Accordingly, the user can conveniently continue to perform current operations.

However, the conventional apparatus 200 has problems in that since there are the configuration in which the single geared motor 230 is used for both the pivoting of the actuating lever 255 in the right and left direction and the movement of the pressure contact piece 270 in the fore and aft direction, and the additional configuration for causing the actuating lever 255 to come into close contact with the page to be turned, the mechanical mechanism of the apparatus is inevitably complicated and operational noises and failures often occur due to large load on the geared motor 230. Further, if the pivoting of the actuating lever 255 and the operation of the pressure contact piece 270 for pressing down the page to be turned and being separated therefrom are not performed in an organic manner, there is a problem in that the page may be crumpled or torn in a worst case.

Moreover, according to the conventional apparatus 200, it is difficult to properly adapt to changes in the thickness and the number of pages of a book since the position of the supporting piece 257 is fixed on the top surface of the casing 250. For example, if a wind blows, a turned page may be easily returned back to a page to be turned. Furthermore, according to the conventional apparatus 200, there is a risk that foreign materials or dust might be introduced into a lever slit 251 and a pressure contact piece slit 252 formed in the top surface of the casing 250, thereby causing operational failures.

In addition, according to the conventional apparatus 200, since the power switch 260 manipulated with a user's foot is connected to the casing 250 by means of an electric wire, there is inconvenience in playing a musical instrument or performing other operations.

SUMMARY OF THE INVENTION

Accordingly, the present invention is conceived to solve the problems in the prior art. An object of the present invention is to provide an apparatus for automatically turning a page of a book, wherein a configuration for holding the book and a configuration for causing an actuating lever to pivot are provided separately from each other while eliminating unnecessary components, thereby reducing operational noises and failures.

Another object of the present invention is to provide an apparatus for automatically turning a page of a music book, which can firmly hold turned pages of the music book and pages thereof to be turned while flexibly adapting to changes in the number of the pages and secure the reliable turning of a relevant page, so that a performer can play a musical instrument smoothly with an easy mind.

A further object of the present invention is to provide an apparatus for automatically turning a page of a book, which holds a lower edge portion of a page to be turned in a bulging state so that only the relevant page may be maintained in a state where it can be easily turned, and reduces a risk that foreign materials may be introduced into a casing of the apparatus.

A still further object of the present invention is to provide an apparatus for automatically turning a page of a book, wherein an internal power supply unit is provided so that the apparatus can be operated without supply of power from the outside.

A still further object of the present invention is to provide an apparatus for automatically turning a page of a book, wherein its operations can be manipulated in a wireless manner.

According to the present invention for achieving the objects, there is provided an apparatus for automatically turning a page of a book, comprising a casing on which a music book can be placed in an opened state; a page holding means which is installed within the casing and holds a page of the opened music book to be turned and a turned page thereof; a page turning means which is installed within the casing to turn a page of the opened music book; a driving means for driving the page holding means and the page turning means; a manipulation means for manipulating operations of the driving means; and a control unit for controlling the operations of the driving means for turning a relevant page of the music book placed on the casing, in response to signals from the manipulation portion.

The page holding means may comprise a first holder and a second holder which are installed within the casing to come out from or get in the casing through first and second holder apertures formed in a top surface of the casing on both lateral sides of a central portion of the music book and hold the page to be turned and the turned page, respectively. The page turning means may comprise an actuating lever which is installed within the casing to come out from or get in the casing through a lever slit formed in a top surface of the casing along the width of the page to be turned from a central portion of the music book and to pivot in a right and left direction on a pivoting shaft adjacent to the central portion of the music book and has a contact member coupled to a distal end thereof to come into contact with the page of the music book to be turned.

The driving means may comprise a pivoting driving portion for causing an actuating lever, which is installed within the casing to pivot in a right and left direction on a pivoting shaft and has a contact member coupled to a distal end thereof to come into contact with the page of the music book to be turned, to pivot so that the actuating lever can come out from or get in the casing through a lever slit formed in a top surface of the casing along the width of the page to be turned from a central portion of the music book; a first holder driving portion for causing a first holder to come into contact with or be separated from the page to be turned in such a manner that the first holder comes out from and gets in the casing through a first holder aperture of first and second apertures formed in a top surface of the casing on both lateral sides of a central portion of the music book; and a second holder driving portion for causing a second holder to come into contact with or be separated from the turned page in such a manner that the second holder comes out from and gets in the casing through the second holder aperture.

The pivoting driving portion may comprise a pivoting shaft unit installed at a central portion of the interior of the casing perpendicularly to the length of the actuating lever to cause the actuating lever to pivot in the right and left direction; a lever driving motor which can rotate in a forward or reverse direction and is disposed adjacent and parallel to the pivoting shaft unit; and a power reduction gear unit which is interposed between the lever driving motor and the pivoting shaft unit to reduce the rotation of the lever driving motor and transmit the reduced rotation to the pivoting shaft unit. The pivoting shaft unit may comprise a bracket formed with shaft holes at opposite sides thereof with the actuating lever interposed therebetween; a pivoting shaft of which both ends are rotatably fitted into the shaft holes of the bracket and through which an end of the actuating lever penetrates to be pivotably coupled thereto; and a guider that is connected via gears to the power reduction gear unit to rotate about the pivoting shaft and has a guide slot which is formed to make an acute angle with respect to an axis of the pivoting shaft and through which the actuating lever penetrates.

The pivoting driving portion may further comprise first and second micro switches provided on opposites sides with respect to the pivoting shaft unit so that the actuating lever can selectively come into contact with the switches upon pivoting of the actuating lever, thereby controlling the operation of the lever driving motor. The pivoting driving portion may further comprise a leaf spring which is installed between the pivoting shaft unit and the lever driving motor to guide the actuating lever in an aft direction along an axis of the pivoting shaft upon pivoting of the actuating lever in the right and left direction.

The first holder driving portion may comprise a pivoting shaft which is installed longitudinally within the casing to cause the first holder secured perpendicularly thereto to come out from or get in the casing through the first holder aperture; and a holder driving motor for rotating the pivoting shaft in a forward or reverse direction. The pivoting shaft may comprise a first holder shaft to which the first holder is secured; a driving shaft coupled to the holder driving motor; and a torsion spring for connecting the first holder shaft to the driving shaft. Preferably, the pressure of the first holder is maintained beyond a predetermined level by means of restoring force of the torsion spring, in response to changes in the thickness of the music book.

The pivoting shaft may further comprise a holder cam and a shaft cam which are installed on the first holder shaft and the driving shaft, respectively, to rotate integrally therewith, and have mutually opposite cam profiles; and third and fourth micro switches which are installed within the radii of the cam profiles of the holder cam and the shaft cam, respectively, so that the holder cam and the shaft cam selectively come into contact with the switches, thereby controlling the rotation of the holder driving motor in the forward or reverse direction.

The second holder driving portion may comprise a second holder shaft for causing the second holder to come out from or get in the casing through the second holder aperture of the casing; a spring installed perpendicular to the second holder shaft to elastically urge the second holder shaft so that the second holder shaft can pivot in a direction in which the second holder comes out from the casing through the second holder aperture; and an interlocking operation bar attached to an end of the first holder shaft so that the second holder which has come out from the casing through the second holder aperture can get back in the casing while being interlocked with the first holder.

The second holder driving portion may comprise a second holder shaft for causing the second holder to pivot such that the second holder can come out from or get in the casing through the second holder aperture formed perpendicularly to the first holder aperture in the top surface of the casing; and bevel gears which are installed on a first holder shaft of the first holder driving portion and on an end of a second holder shaft provided perpendicularly to the first holder shaft, respectively, to transmit rotational force of the first holder shaft to the second holder shaft.

The casing may further comprise an actuation switch and a fifth micro switch for controlling the operations of the driving means by sensing whether the music book is placed on the top surface of the casing.

A cover may be pivotably installed on the casing to cause the top surface of the casing to be covered or exposed to the outside, and an inner surface of the cover is provided with a cover holder for partially holding the page to be turned and a cover boss protruding from a portion of the inner surface of the cover adjacent to the cover holder so that the page to be turned can curvedly bulge in a fore direction.

The casing may be provided with an external power supply unit, and an internal power supply unit that can be selectively used and accommodate a rechargeable battery.

The manipulation portion may further comprise an RF signal generator mounted on a foot switch; and an RF signal sensor for sensing RF signals from the RF signal generator and transmitting the sensing results to the control unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE INVENTION

Hereinafter, preferred embodiments of the present invention will be described in detail with reference to the accompanying drawings. For the convenience of the description and clear understanding, a case where a music book is placed on an apparatus for automatically turning a page of a book according to the present invention will be explained by way of example.

Figure 1:
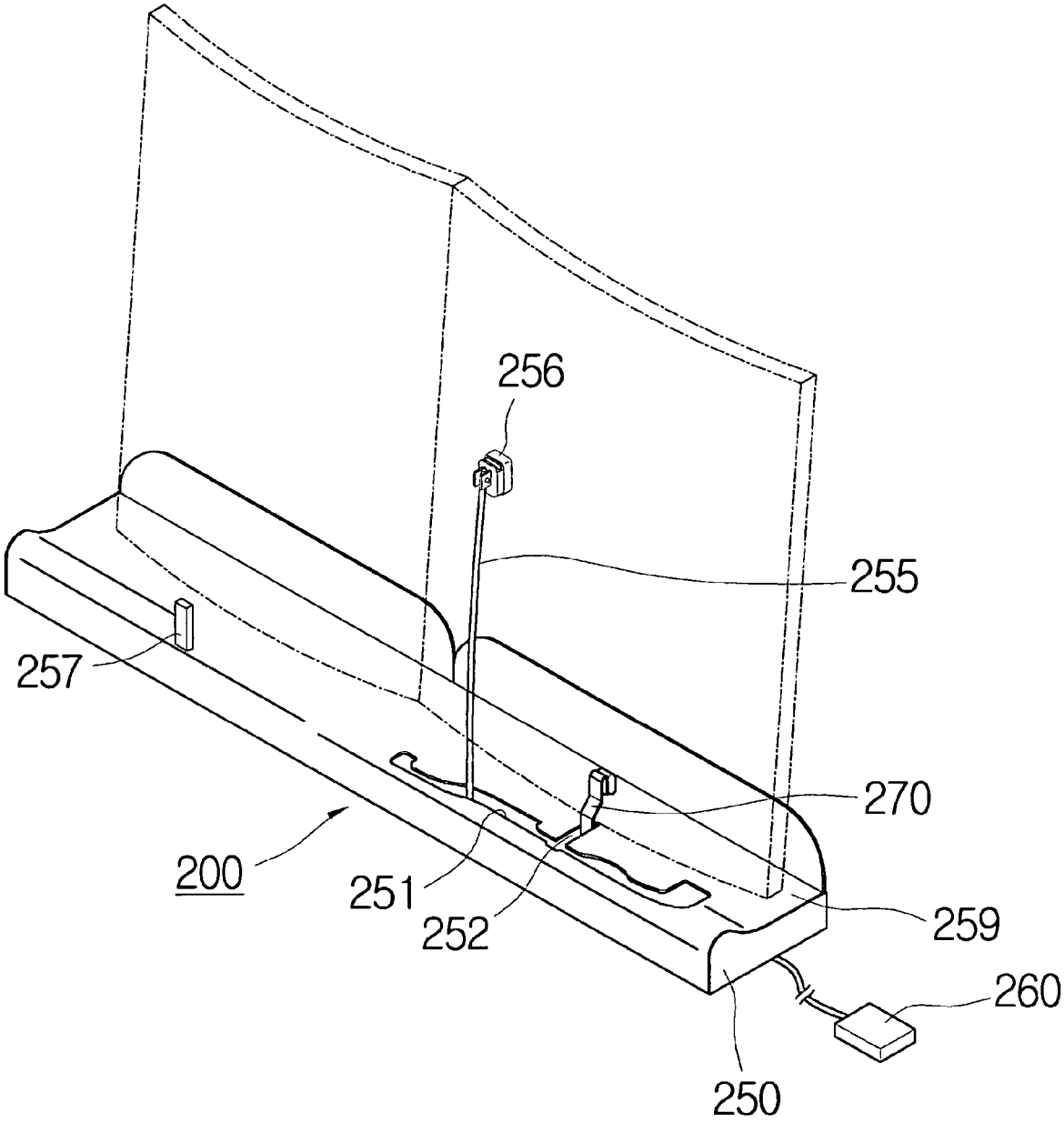
FIG. 1 PRIOR ART
FIG. 1 is a perspective view of a conventional apparatus for automatically turning a page of a music book, which was proposed by the present inventor.
Figure 2:
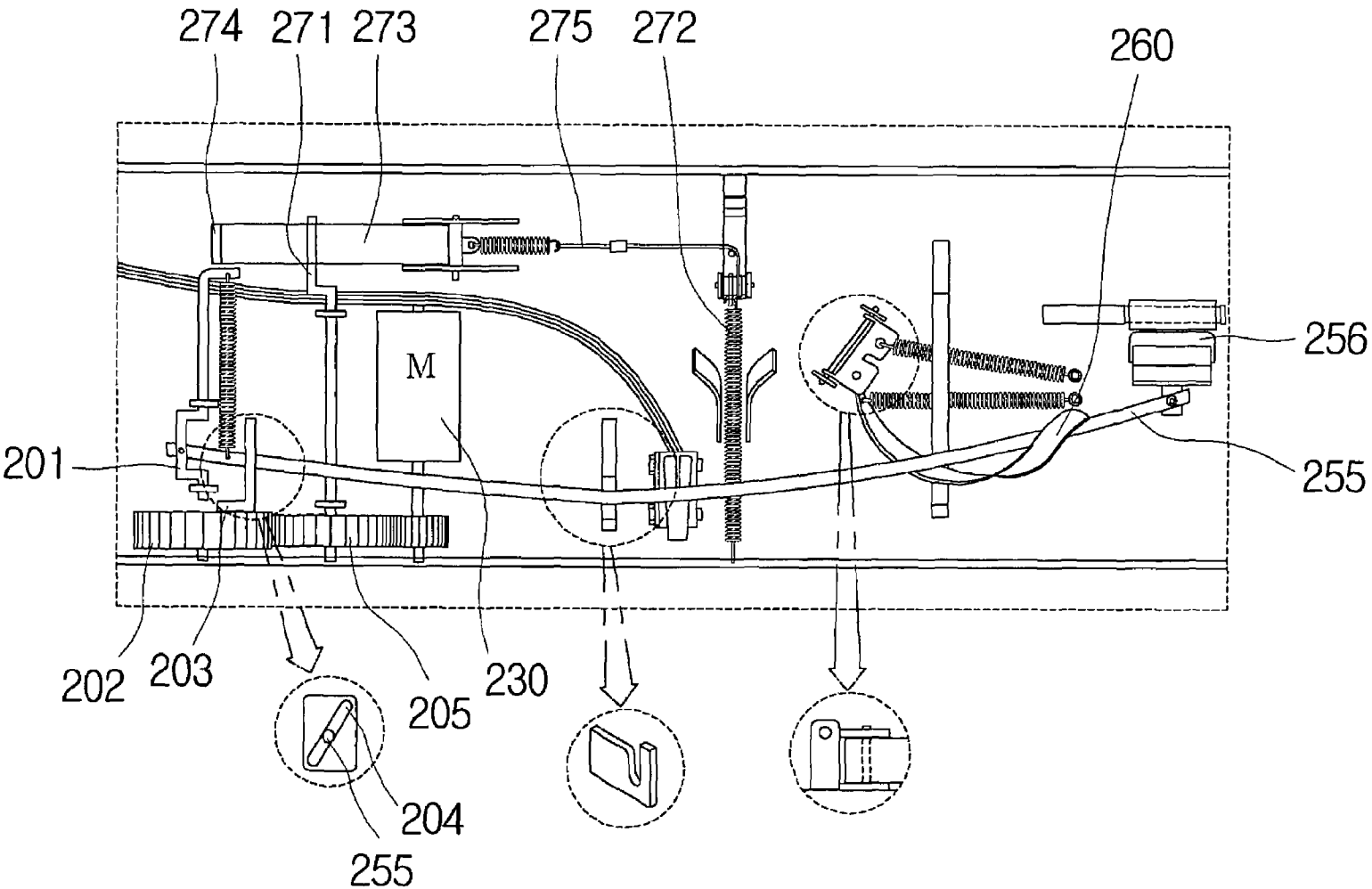
FIG. 2 PRIOR ART
FIG. 2 is an enlarged view of a major portion of FIG. 1.
Figure 3:
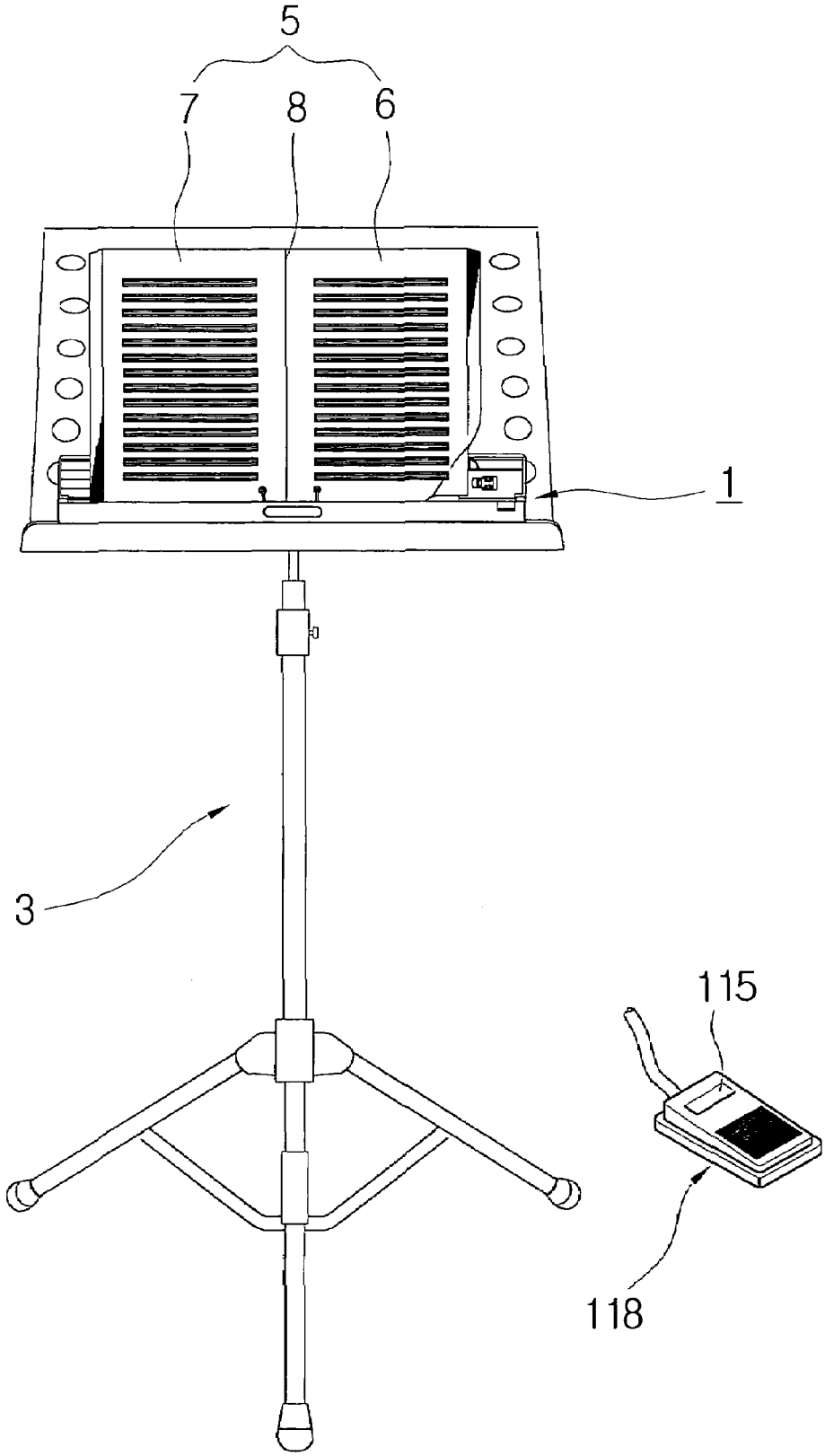
FIG. 3 shows a state where an apparatus for automatically turning a page of a book according to the present invention is seated on a Canterbury, a cover of the apparatus is opened and a music book is then placed on the apparatus.
Figure 4:
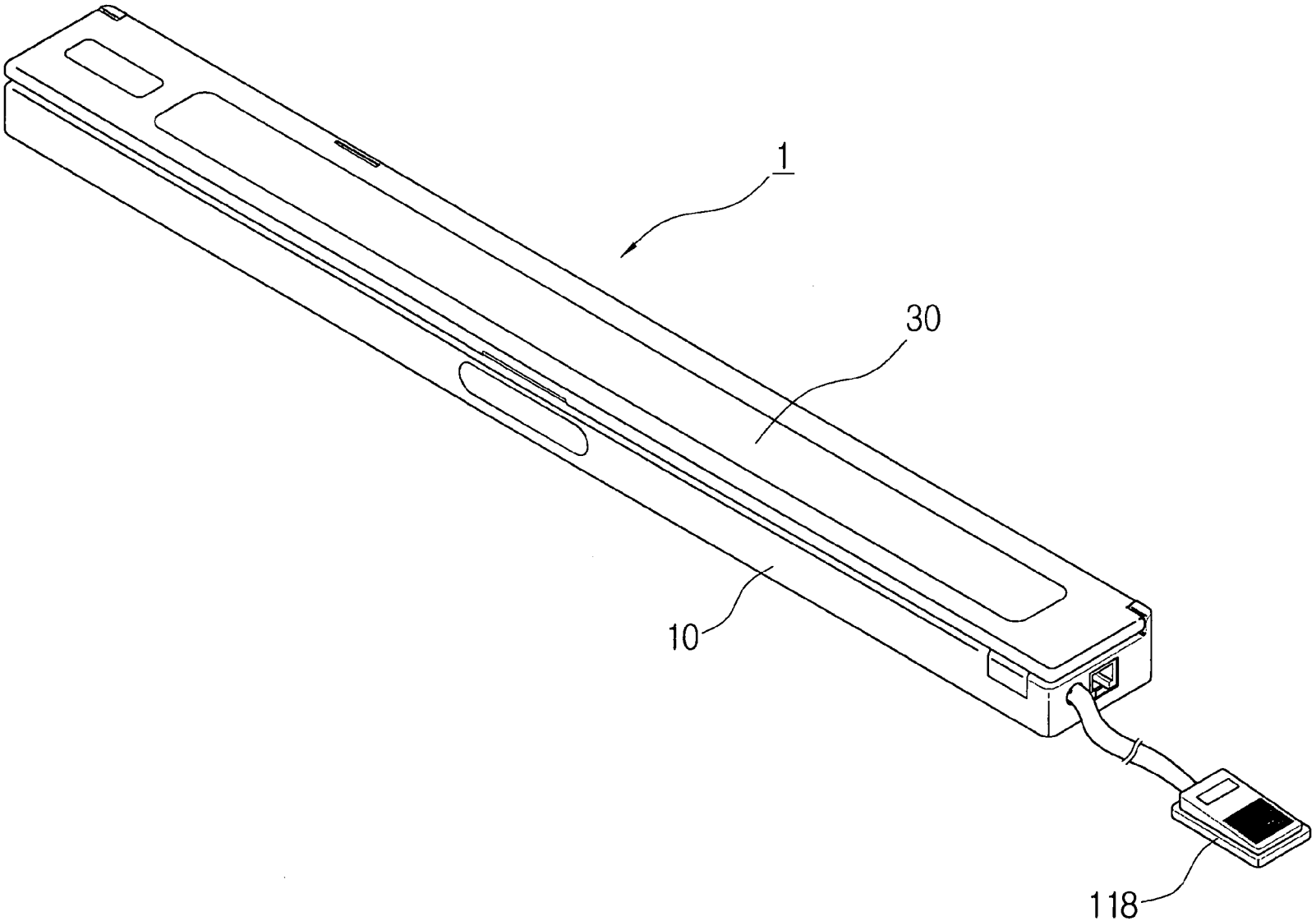
FIG. 4 is a perspective view of the apparatus for automatically turning a page of a book according to the present invention.
Figure 5:
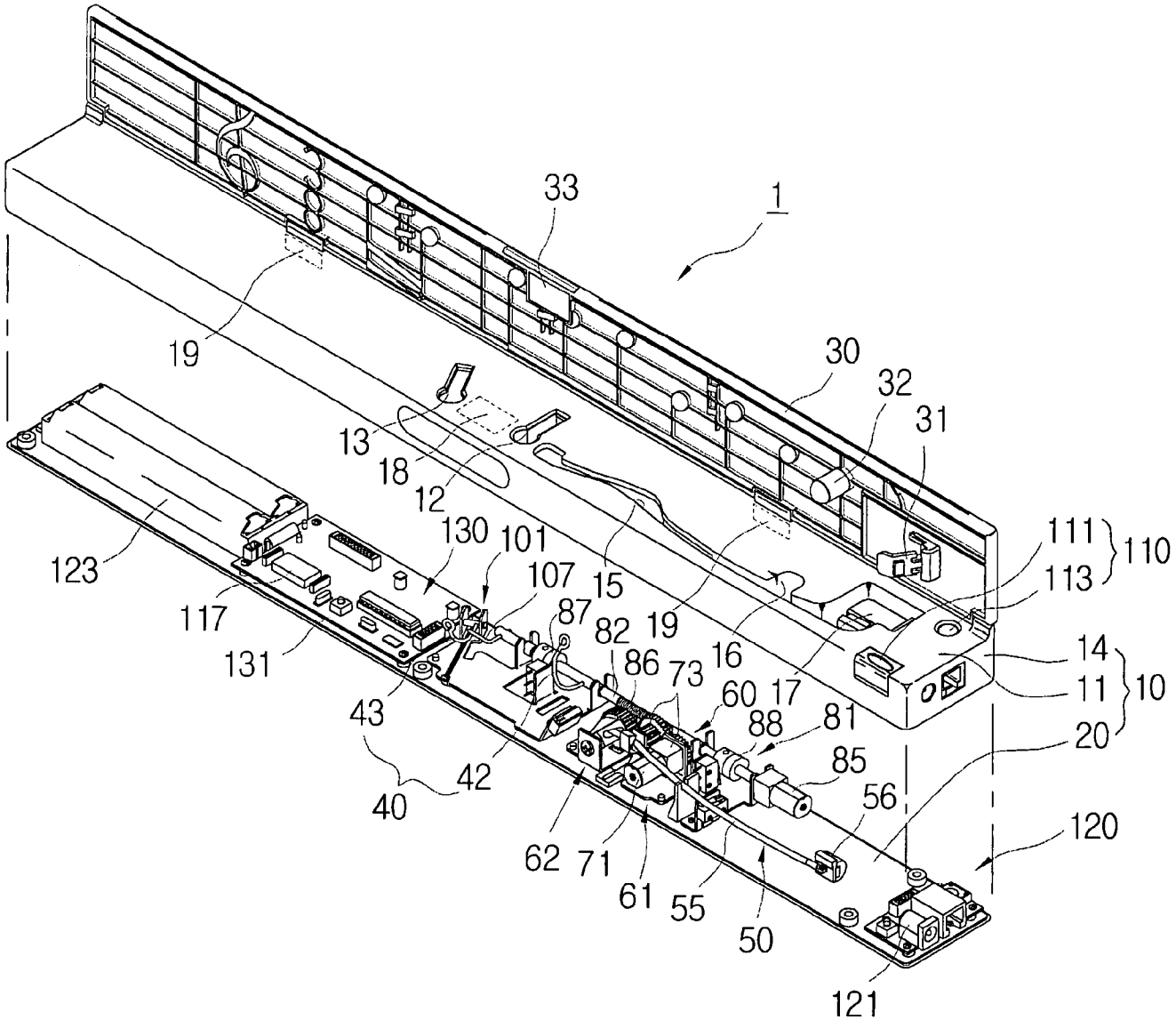
FIG. 5 is an exploded perspective view of the apparatus of FIG. 4 in a state where the cover of the apparatus is opened.

As shown in FIG. 3, the apparatus 1 of the present invention supports a music book 5 placed on a Canterbury 3 such that it can turn a page of the music book. FIG. 4 is a perspective view of the apparatus for automatically turning a page of a book according to the present invention, and FIG. 5 is an exploded perspective view of the apparatus of FIG. 4 in a state where a cover of the apparatus is opened. As can be seen from these figures, the apparatus 1 comprises a casing 10 on which the music book 5 can be placed in an opened state; first and second holders 42 and 43 installed within the casing 10 to hold a page 6 of the music book to be turned and a turned page 7 thereof, respectively; an actuating lever 55 for turning the page 6 to be turned toward the turned page 7; and a driving means 60 for driving the first and second holders 42 and 43 and the actuating lever 55. The apparatus 1 further comprises a manipulation portion 110 for manipulating the driving means 60; a control unit 130 for controlling the operation of the driving means 60 in response to manipulation signals from the manipulation portion 110; and a power supply unit 120.

The casing 10 takes the shape of a rectangular box, and comprises a bottom plate 20 and top and side plates 11 and 14 for integrally covering the bottom plate 20. The top plate 11 is provided with holder apertures 12 and 13 therethrough on both sides of a central portion 8 of the opened music book 5. The top plate 11 is further provided with a lever slit 15 extending widthwise of the page 6 to be turned from the central portion 8 of the music book 5. The holder apertures 12 and 13 are formed to be elongated widthwise of the casing 10. The holder aperture 13 provided on the side of the turned page 7 is formed to make a predetermined angle with respect to the first holder aperture 12 provided on the side of the page 6 to be turned.

Further, a top surface of the casing 10 is provided with the manipulation portion 110 at a portion thereof outside the lever slit 15. The manipulation portion 110 comprises a power button 113 for turning on/off the apparatus 1, and a manipulation button 111 for causing the actuating lever 55 to pivot once, thereby turning the page 6. A pivotably openable cover 30 is installed in the top surface of the casing 10.

The cover 30 can pivot in a fore and aft direction on a pivoting shaft that is installed along a longitudinal rear edge of the top surface of the casing 10. A cover holder 31 for holding pages of the music book 5 to be turned is installed on an inner surface of the cover 30. A cover boss 32 protrudes from a portion of the inner surface of the cover that is spaced inwardly from the cover holder 32. The cover boss 32 pushes an end portion of the page 6 to be turned in the fore direction so that the end portion of the page 6 can bulge curvedly, thereby accurately and easily turning only a relevant page as specifically described later. The cover holder 31 and the cover boss 32 are accommodated within accommodation recesses 16 and 17 formed in the top surface of the casing 10, respectively, when the cover 30 is pivotably closed.

Figure 6:
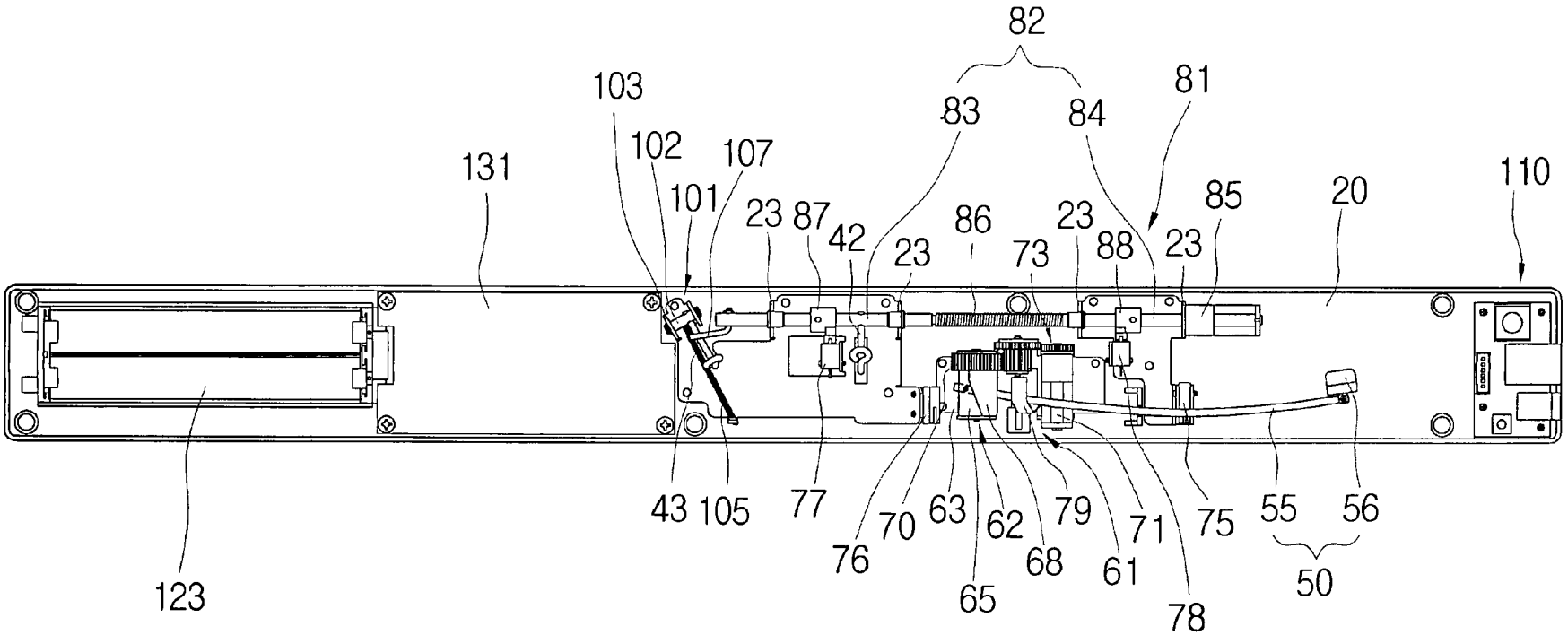
FIG. 6 is a plan view of a major portion of FIG. 5, specifically showing the configuration of the apparatus.
Figure 7:
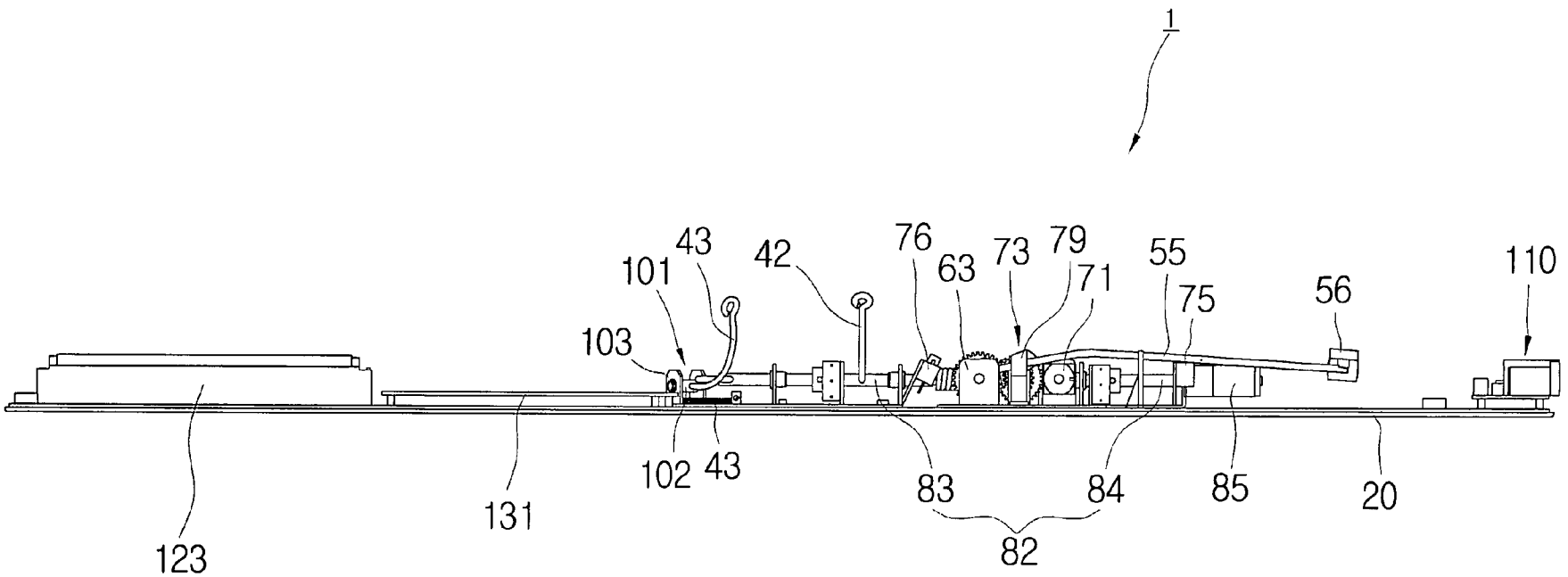
FIG. 7 is a front view of FIG. 6.

FIG. 6 is a plan view of a major portion of FIG. 5, specifically showing the configuration of the apparatus 1. FIG. 7 is a front view of FIG. 6. As shown in these figures, on the bottom plate 20 of the casing 10, the pair of first and second holders 42 and 43 is installed at a central portion thereof, and the actuating lever 55 and the driving means 60 for driving the first and second holders 42 and 43 and the actuating lever 55 are installed at one side with respect to the holders 42 and 43, i.e. at a position below the page 6 of the music book 5 to be tuned. Further, a printed circuit board (PCB) 131 constructing the control unit 130 and an internal power supply unit 123 are provided at the other side with respect to the holders 42 and 43, i.e. at a position below the turned page 7 of the music book 5.

The first and second holders 42 and 43 come out from or get in the casing through the first and second holder apertures 12 and 13 formed in the top plate 11 of the casing 10, respectively. The actuating lever 55 is arranged parallel to the lever slit 15 and pivots in a right and left direction on a pivoting shaft 65 provided at a position below the central portion 8 of the music book 5. A contact member 56 made of rubber that is to come into contact with the page 6 of the music book 5 to be turned is coupled to an upper end of the actuating lever 55.

Figure 8:
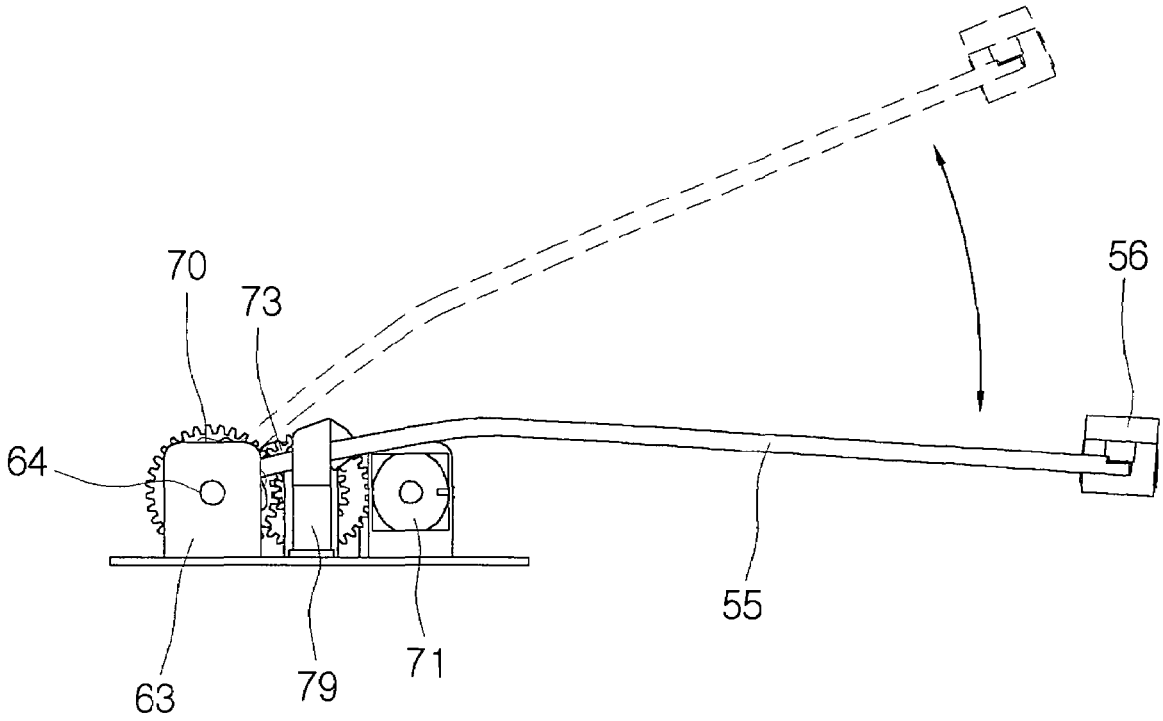
FIG. 8 is an enlarged view of a portion of FIG. 7, specifically showing an actuating lever and its pivoting driving portion of the apparatus according to the present invention.
Figure 9:
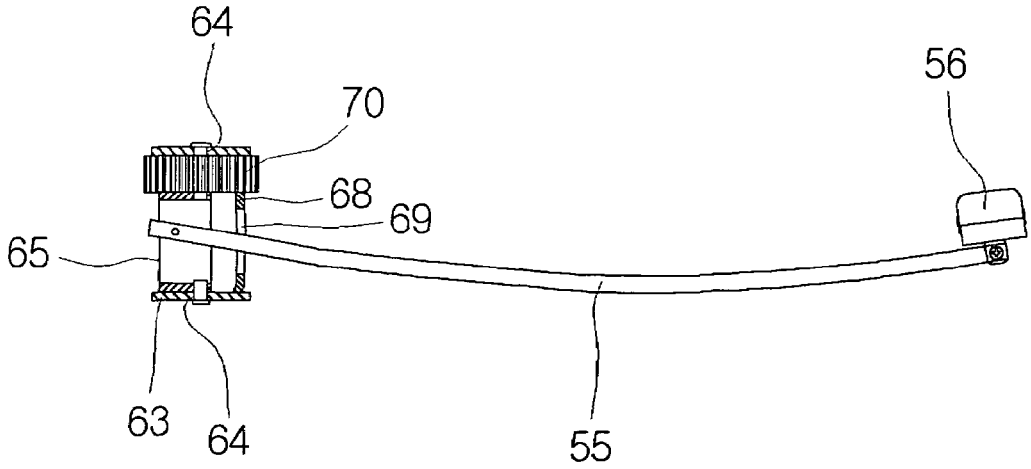
FIG. 9 is a partially sectional plan view of FIG. 8, specifically showing the structure of a pivoting shaft unit of the pivoting driving portion.

The driving means 60 comprises a pivoting driving portion 61 for causing the actuating lever 55 to pivot, and first and second holder driving portions 81 and 101 for causing the first and second holders 42 and 43 to come out from or get in the casing, respectively. As shown in FIG. 8, the pivoting driving portion 61 comprises a pivoting shaft unit 62 including the pivoting shaft 65 for the actuating lever 55, a lever driving motor 71 adjacent to the pivoting shaft unit 62, and a power reduction gear unit 73 interposed between the pivoting shaft unit 62 and the lever driving motor 71.

As shown in FIG, 9, the pivoting shaft unit 62 of the pivoting driving portion 61 comprises the pivoting shaft 65 for the actuating lever 55, a bracket 63 for supporting the pivoting shaft 65, and a guider 68 interlocked with the pivoting shaft 65 to cause the actuating lever 55 to pivot in a direction perpendicular to the lateral pivoting direction of the actuating lever 55. Both ends of the pivoting shaft 65 are rotatably fitted into shaft holes 64 formed in both sides of the bracket 63. A lower end of the actuating lever 55 penetrates through a central portion of the pivoting shaft 65 and is coupled thereto so that the actuating lever 55 can freely pivot.

The guider 68 is installed to run idle while partially surrounding the pivoting shaft 65 and has a guide slot 69 that makes an acute angle downwardly with respect to an axis of the pivoting shaft 65. The actuating lever 55 of which the lower end is coupled to the pivoting shaft 65 penetrates through the guide slot 69. A driven gear portion 70 that receives rotational force from the power reduction gear unit 73 is formed integrally with one side of the guider 68.

The power reduction gear unit 73 has the same structure as a general gear unit in which a plurality of gears are engaged with one another, and functions to properly reduce forward or reverse rotational force of the lever driving motor 71 and to transmit the reduced rotational force to the guider 68.

Then, the guider 68 receiving the rotational force runs idle around the pivoting shaft 65. Accordingly, the actuating lever 55 penetrating through the guide slot 69 pivots on the pivoting shaft 65 in the right and left direction. At this time, the actuating lever 55 that pivots in the right and left direction moves along the guide slot 69 making the predetermined angle with respect to the horizontal direction.

That is, the actuating lever 55 that is pivoting upwardly comes out from the casing through the lever slit 15 formed in the casing 10 and simultaneously pivots in the aft direction toward the page 6 of the music book 5 to be turned by means of the guide slot 69. Thus, the contact member 56 coupled to the upper end of the actuating lever 55 comes into contact with the relevant page 6. On the other hand, when the actuating lever 55 is lowered, the actuating lever 55 pivots in a direction opposite to the pivoting direction when it is raised, i.e. in the fore direction, and is then accommodated within the casing 10 through the lever slit 15. Further, the actuating lever 55 can smoothly pivot in the direction perpendicular to the lateral pivoting direction, i.e. in the fore and aft direction, by means of a leaf spring 79 installed between the pivoting shaft unit 62 and the lever driving motor 71.

Meanwhile, the pivoting driving portion 61 further comprises a pair of first and second micro switches 75 and 76 installed within the radius of the lateral pivoting of the actuating lever 55. The first micro switch 75 is provided at a position below the page 6 of the music book 5 to be turned and the second micro switch 76 is provided at a position below the turned page 7 of the music book 5, so that the actuating lever 55 can selectively come into contact with the first and second micro switches. The control unit 130 controls the operation of the lever driving motor 71 in response to on/off signals from the first and second micro switches 75 and 76.

Figure 10:
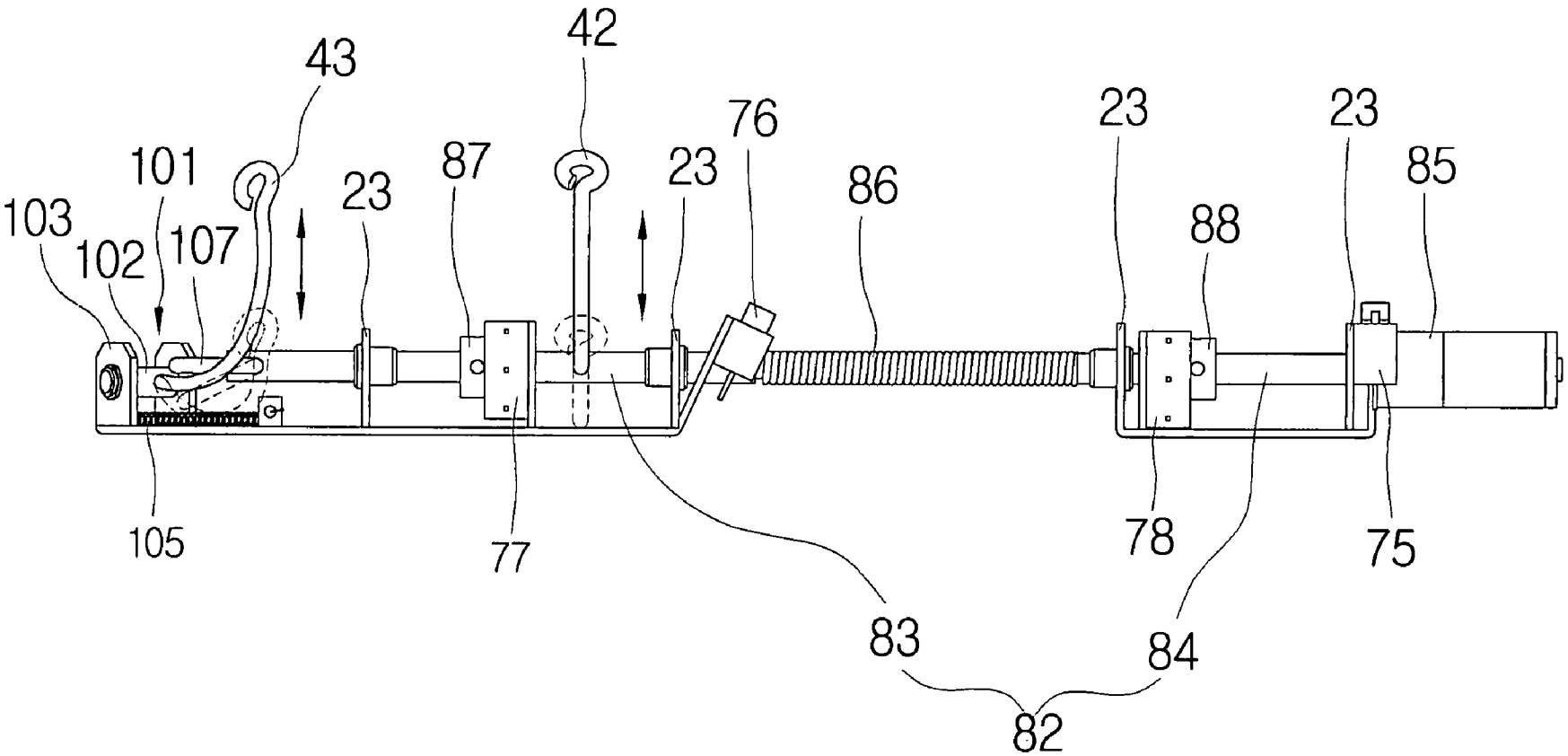
FIG. 10 is an enlarged view of a portion of FIG. 7, specifically showing first and second holder driving portions of the apparatus of the present invention.
Figure 11:
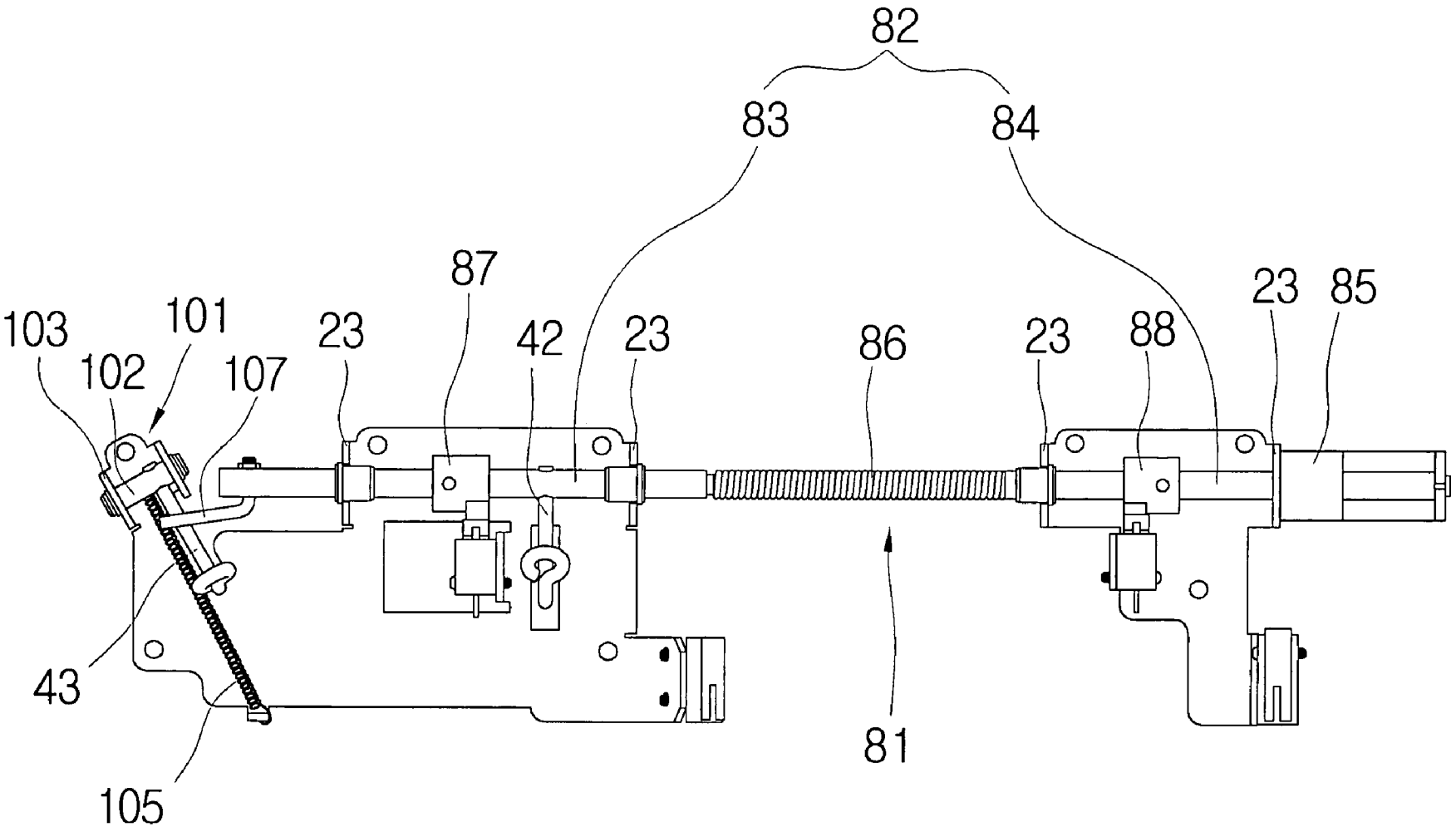
FIG. 11 is a plan view of FIG. 10.

FIG. 10 is an enlarged view of a portion of FIG. 7, specifically showing the first and second holder driving portions of the apparatus of the present invention. FIG. 11 is a plan view of FIG. 10. As shown in these figures, the first holder driving portion 81 for causing the first holder 42 to come out from or get in the casing through the holder aperture is installed at the rear of the pivoting driving portion 61, and comprises a pivoting shaft 82 for causing the first holder 42 to pivot and a holder driving motor 85 for rotating the pivoting shaft 82 in the forward or reverse direction. The pivoting shaft 82 is rotatably installed along the length of the casing 10 and is divided into a driving shaft 84 and a first holder shaft 83 that are axially disposed at right and left positions. The driving shaft 84 and the first holder shaft 83 are supported by support pieces 23 installed at predetermined intervals along the length of the casing on the bottom plate 20.

A distal end of the driving shaft 84 is connected to the holder driving motor 85. Further, the first holder 42 is fixed to the first holder shaft 83 in a direction perpendicular to the axial direction thereof so that it can pivot to come out from or get in the casing through the first holder aperture 12 formed in the top plate 11 of the casing 10. A torsion spring 86 is interposed between the driving shaft 84 and the first holder shaft 83. A rotational angle of the first holder shaft 83 with respect to the driving shaft 84 can vary due to restoring force of the torsion spring 86. Thus, the first holder 42 can firmly hold the music book 5 by properly adapting to changes in the thickness of the music book 5.

Further, a shaft cam 88 and a holder cam 87 are coupled to outer ends of the driving shaft 84 and the first holder shaft 83, respectively. It is preferred that the shaft cam 88 and the holder cam 87 be coupled to the ends of the respective shafts 83 and 84 to form mutually opposite cam profiles. Moreover, third and fourth micro switches 77 and 78 with which the shaft cam 88 and the holder cam 87 come into contact, respectively, are installed on the bottom plate 20. The third and fourth micro switches 77 and 78 come into contact with the cam profiles of the holder cam 87 and the shaft cam 88 with a predetermined angular difference therebetween. Accordingly, the control unit 130 controls the operation of the holder driving motor 85 in response to signals from the third and fourth micro switches 77 and 78.

Meanwhile, the second holder driving portion 101 comprises a second holder shaft 102 with the second holder 43 coupled thereto, an interlocking operation bar 107 for causing the second holder 43 to be interlocked with the first holder 42 and to pivot therewith, and a spring 105 for elastically urging the second holder shaft 102 so that the second holder 43 can be rotated in a direction in which it come out from the casing. The second holder shaft 102 is arranged perpendicularly to the second holder aperture 13 formed in the top plate 11 of the casing 10, and a bracket 103 for rotatably supporting the second holder shaft 102 is installed on the bottom plate 20 of the casing 10.

The interlocking operation bar 107 protrudes in the fore direction from the end of the first holder shaft 83 and is then bent and extends to be in contact with the second holder shaft 102. The interlocking operation bar 107 pivots with a predetermined radius on the first holder shaft 83, and simultaneously causes the second holder shaft 102, which the bar 107 comes into contact with within the pivoting radius, to pivot while overcoming the force of the spring 105.

Meanwhile, the power supply unit 120 provided on the bottom plate 20 of the casing 10 is divided into an external power supply unit 121 and the internal power supply unit 123. The external power supply unit 121 includes, for example, a receptacle to which a cable capable of supplying a commercial voltage is connected, and a voltage transforming portion for transforming the voltage introduced through the receptacle into a voltage suitable for the driving means 60 of the apparatus 1 of the present invention. The internal power supply unit 123 includes, for example, a accommodation bracket on which a rechargeable battery can be mounted.

Further, the manipulation portion 110 comprises a foot switch 118 that is installed separately from the casing 10 so that a user can press the switch with his/her foot, and a cable for connecting the foot switch 118 to the manipulation portion 110 so that signals can be transmitted therebetween. The manipulation portion 110 further comprises an RF signal generator 115 for generating RF signals, and an RF signal sensor 117 for sensing the RF signals. At this time, the RF signal generator 115 substitutes for the foot switch 118 if the cable is not connected, and a slot in which the RF signal sensor 117 is mounted is preferably formed in the PCB 131.

Next, the operation of the apparatus for automatically turning a page of a book according to the present invention constructed as above will be described in detail with reference to FIG. 12.

Figure 12:
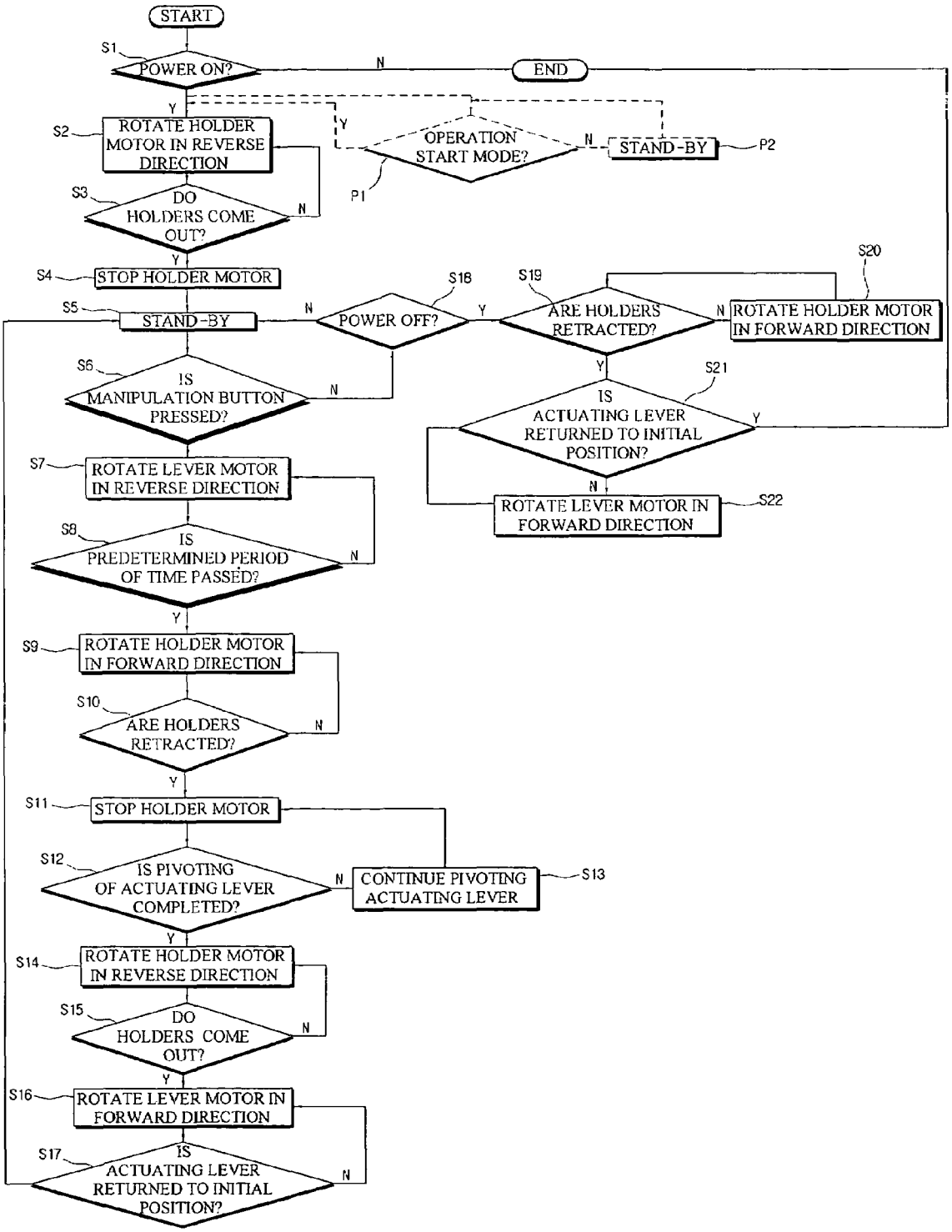
FIG. 12 is a flowchart illustrating how the apparatus of the present invention operates.

FIG. 12 is a flowchart illustrating how the apparatus of the present invention operates. In order to operate the apparatus of the present invention, the cover 30 of the apparatus is first opened and the music book 5 is placed on the top surface of the casing 10 in an opened state. Then, when the power button 113 is pressed to turn on the apparatus (S1), the holder driving motor 85 rotates in a reverse direction (S2) to rotate the driving shaft 84. The first holder shaft 83 interlocked with the driving shaft 84 is also rotated. Then, the first holder 42 fixed to the first holder shaft 83 comes out from the casing through the first holder aperture 12 while pivoting upwardly to stand up. At the same time, the interlocking operation bar 107 is also rotated together with the first holder shaft 83. Thus, as the second holder 43 that has been rotated downwardly due to pressure of the interlocking operation bar 107 is released from the pressed state, the restoring force of the spring 105 that has been stretched acts on and rotates the second holder shaft 102. Accordingly, the second holder 43 comes out from the casing through the second holder aperture 13 while pivoting upwardly to stand up.

Meanwhile, the upward pivoting of the first and second holders 42 and 43 is stopped when the cam profile of the shaft cam 88 coupled to the driving shaft 84 comes into contact with and turns off the fourth micro switch 78 (S4).

Therefore, the control unit 130 rotates the holder driving motor 85 in the reverse direction to cause the respective holders 42 and 43 to come out from the casing while checking whether a signal from the fourth micro switch 78 is applied thereto (S3). The first and second holders 42 and 43 that has pivoted upwardly and come out from the casing in such a manner press down the page 6 of the music book 5 to be turned and the turned page 7 thereof, respectively, and stand by in such a holding state (S5).

In this state, when the user presses the manipulation button 111 (S6), the lever driving motor 71 begins to rotate in a reverse direction (S7). Then, the actuating lever 55 comes out from the casing through the lever slit 15 of the casing 10 while pivoting upwardly, and moves toward the music book 5 along the guide slot 69 of the guider 68. Accordingly, the contact member 56 of the actuating lever 55 comes into contact with the page 6 to be turned. Here, upon passage of a predetermined period of time after the lever driving motor 71 begins to operate (S8), in other words, upon passage of a predetermined period of time after the actuating lever 55 is separated from the first micro switch 75, the holder driving motor 85 begins to rotate in a forward direction (S9).

The forward rotation of the holder driving motor 85 causes the first and second holders 42 and 43 to pivot downwardly so that the holders can be separated from the respective pages 6 and 7 (S10). Thus, the actuating lever 55 is in a state where it can easily turn the page 6 to be turned. Here, the forward rotation of the holder driving motor 85 is stopped when the cam profile of the holder cam 87 coupled to the first holder shaft 83 comes into contact with and turns off the third micro switch 77 to stop the holder driving motor 85 (S11).

Meanwhile, the contact member 56 of the actuating lever 55 that is pivoting upwardly is raised in a state where it is in close contact with a front face of the page 6 of the music book 5 to be turned of which a portion has protruded curvedly in the fore direction by means of the cover boss 32 of the cover 30. Thus, the relevant portion of the page 6 further bulges in the fore direction. Accordingly, the actuating lever 55 that continues to pivot upwardly pushes aside the lower end of the page 6 to be turned and is then positioned on the back of the page. In this state, the actuating lever 55 pivots leftward along an arc to turn the relevant page 6 to the left.

When the actuating lever 55 that pivots in such a manner comes into contact with and turns off the second micro switch 76 installed within the radius of the pivoting of the actuating lever (S12), a signal from the second micro switch 76 is applied to the control unit 130. Then, the control unit 130 stops the reverse rotation of the lever driving motor 71 and rotates the holder driving motor 85 again in the reverse direction (S14). Therefore, the lever driving motor 71 continues to rotate in the reverse direction until the actuating lever 55 comes into contact with the second micro switch 76 (S13). Thereafter, when the first and second holders 42 and 43 come out from the casing, and press down and hold a new page to be turned and the turned page due to the reverse rotation of the holder driving motor 85 (S15), the lever driving motor 71 rotates in the forward direction (S16) so that the actuating lever 55 can be returned to its initial position (S17). Then, the apparatus stands by until the user manipulates again the manipulation button 111 (S5).

If the power button 113 is pressed rather than selection of the manipulation button 111 in such a stand-by state (S18), the control unit 130 first checks the positions of the first and second holders 42 and 43 (S19) and then rotates the holder driving motor 85 in the forward direction (S20) so that the first and second holders 42 and 43 can be returned to their initial positions within the casing 10. Then, the control unit 130 checks the position of the actuating lever 55 (S21) and rotates the lever driving motor 71 in the forward direction (S22) so that the actuating lever 55 can also be returned to its initial position within the casing 10. Finally, the control unit turns off the apparatus.

Figure 13:
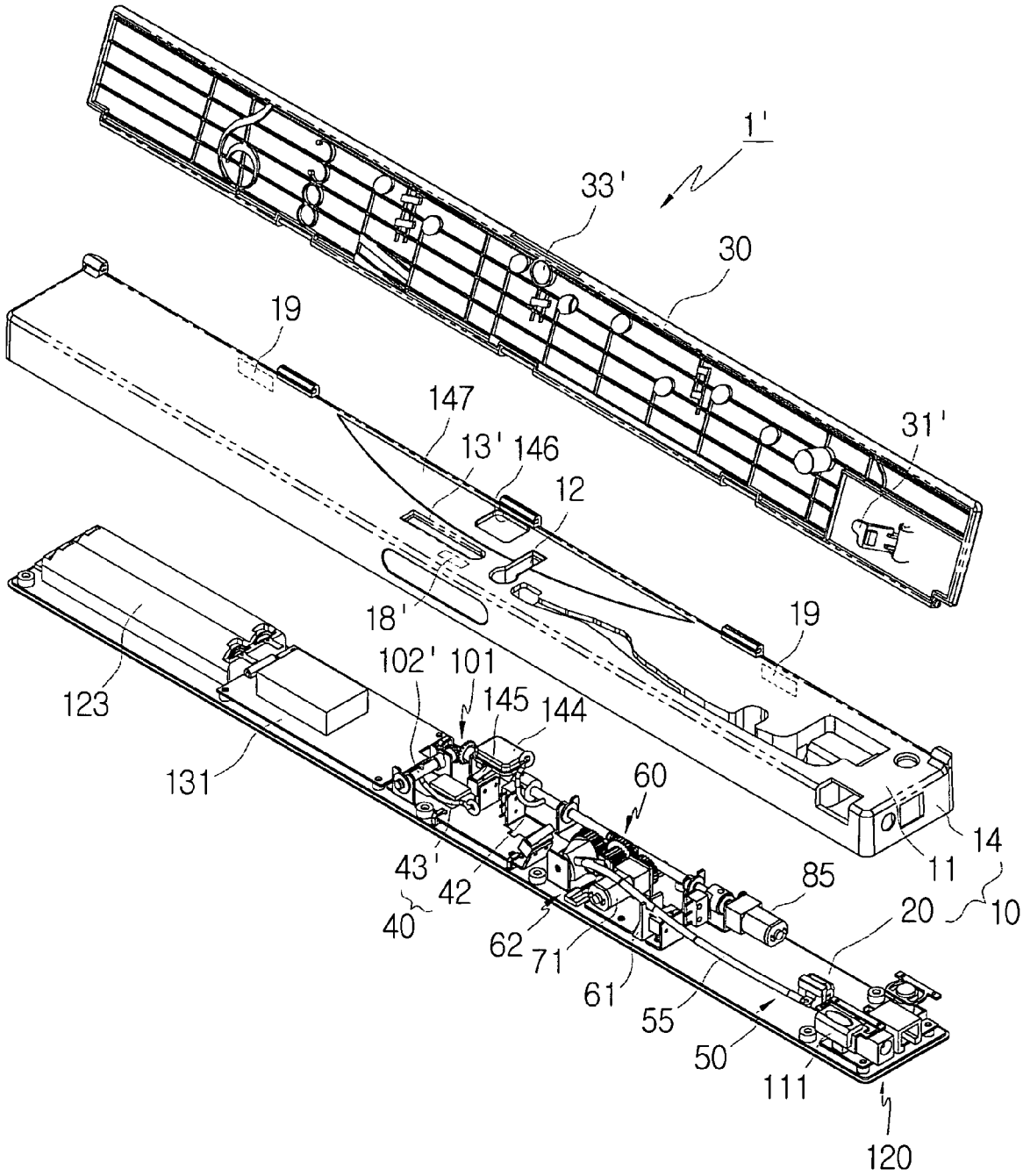
FIG. 13 is an exploded view of an apparatus for automatically turning a page of a book according to another embodiment of the present invention.
Figure 14:
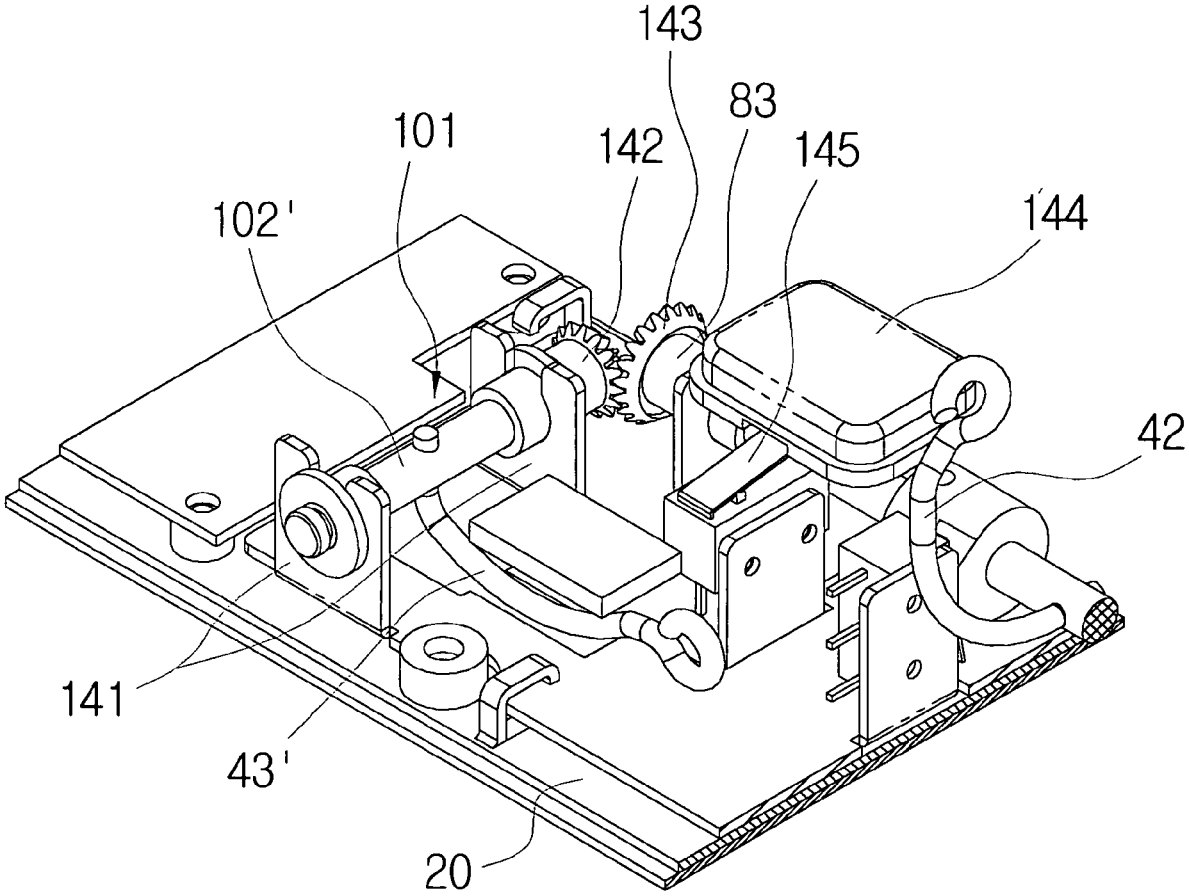
FIG. 14 is an enlarged view of a major portion of FIG. 13, specifically showing a second holder driving portion of the apparatus.

FIG. 13 is an exploded view of an apparatus for automatically turning a page of a book according to another embodiment of the present invention. As shown in the figure, the apparatus 1' according to this embodiment of the present invention is almost similar to the apparatus 1 according to the previous embodiment of the present in view of their constitutions. There is a difference therebetween in only the structure of the second holder driving portion. FIG. 14 specifically shows a second holder driving portion 101' having a different structure.

Referring to this figure, the second holder driving portion 101' in the embodiment of the present invention comprises a second holder shaft 102' disposed perpendicularly to the first holder shaft 83, and a pair of bevel gears 142 and 143 for transmitting rotational force from the first holder shaft 83 to the second holder shaft 102'. The second holder shaft 102' is rotatably supported by a pair of support pieces 141 installed on the bottom plate 20 of the casing 10.

The driven bevel gear 142 is coupled to one end of the second holder shaft 102' adjacent to the first holder shaft 83, and the driving bevel gear 143 is coupled to an end of the first holder shaft 83. The driving bevel gear 143 and the driven bevel gear 142 are engaged with each other, so that the rotational force of the first holder shaft 83 can be transmitted to the second holder shaft 102'.

Meanwhile, a second holder 43' is pivotably coupled to the other end of the second holder shaft 102'. The top surface of the casing 10 is provided with a second holder aperture 13' perpendicularly to the first holder aperture 12 so that the second holder 43' comes out from or gets in the casing through the second holder aperture 13'. The second holder 43' that has come out from the casing through the second holder aperture 13' is very advantageous in that it can also effectively hold a turned page of the music book that is almost vertically supported by the Canterbury 3.

Further, in the apparatus 1' of this embodiment, a fifth micro switch 145 is installed on a portion of the bottom plate in the vicinity of the first holder 42. The fifth micro switch 145 cooperates with an actuation switch 144 which is provided above the switch 145 and supported, for example, by an elastic spring (not shown) and on which upward elastic force of the spring is exerted. The switch 144 is upwardly exposed through a central aperture 146 formed in the top surface of the casing 10 and comes into contact with the central portion of the music book 5 placed on the top surface of the casing 10.

When the music book 5 is placed on the top surface of the casing 10, the switch 144 is pressed due to the weight of the music book and thus the fifth micro switch 145 is pressed. Then, the fifth micro switch 145 is turned on so that the apparatus can enter an operation start mode.

Accordingly, the switch 144 and the fifth micro switch 145 functions to prevent breakage of the apparatus that may occur due to the driving of the holder driving motor 85 and the lever driving motor 71 in a no-load state, i.e. in a state where a music book is not placed on the apparatus 1'.

Therefore, as indicated by dashed lines in the flowchart of FIG. 12, the user can operate the respective driving motors 71 and 85 by pressing the manipulation button 111 only when the fifth micro switch 145 is turned on and the apparatus is in the operation start mode (P1). In other words, the user cannot operate the driving motors 71 and 85 even though he/she presses the manipulation button 111 in a state where the switch 145 is turned off, i.e. in a state where a music book is not placed thereon.

Further, in the apparatus 1' of this embodiment, a central portion of the top surface of the casing 10, more specifically, a portion 147 on which the music book 5 is placed, protrudes with respect to other portions of the top surface. It can be seen in FIG. 13 that the portion 147 is formed to take the shape of an arc in consideration of design and the like. When the music book 5 is placed on the protruding portion 147, the contact area of a lower edge of the music book with the top surface of the casing is decreased, thereby more easily turning a page of the music book.

Moreover, in the apparatus 1' of this embodiment, an end of a cover holder 31' is partially cut away in order to prevent the actuating lever 55 from coming into contact with the cover holder 31' within the radius of the pivoting of the actuating lever 55 that pivots by means of the driving of the lever driving motor 71.

The apparatus 1' of this embodiment constructed as above operates in the same manner as the apparatus 1 of the previous embodiment, except that the apparatus 1' enters the operation start mode (P1) when the music book 5 is placed thereon but stands by for a predetermined period of time (P2) when a music book is not placed thereon, as indicated by the dashed lines in the flowchart of FIG. 12. Therefore, a description thereof will be omitted. However, it will be apparent that the apparatus 1' of this embodiment can achieve and obtain the same objects and effects as the apparatus 1 of the previous embodiment.

It will also be apparent that the structures and configurations of the switch 144, the fifth micro switch 145, the protruding portion 147 at the central portion of the top surface of the casing 10, and the cover holder 31' of the apparatus 1' of this embodiment may be applied to the apparatus 1 of the previous embodiment described with reference to FIGS. 3 to 12, thereby obtaining the same effects.

Meanwhile, in the apparatus 1 or 1' of the embodiment described and illustrated above, it is preferred that magnets 19 be installed on two portions of an inner surface of the rear side plate of the casing 10. When the apparatus 1 or 1' of the present invention is seated, for example, on a Canterbury made of metal material, the magnets 19 functions to stably maintain the apparatus in the seated state. Further, it is preferred that a magnet 33 or 33' be installed on one of a central area of the cover 30 and a portion of the top surface of the casing 10 and a magnet or a piece of steel plate 18 or 18' be installed on a portion of the other.

Further, although the operation of the apparatus for turning a relevant page through the pressing of the manipulation button 111 has been described in the embodiments described and illustrated above, it will be apparent that the operation may be performed by manipulating the foot switch 118 or the RF signal generator 115.

According to the apparatus of the present invention described above, the configuration for holding pages of a music book, including the holder driving motor, can firmly hold turned pages and pages to be turned by flexibly adapting to changes in the numbers of the pages of the music book that have been already turned and are to be turned. In addition, the configuration for causing the actuating lever to pivot, including the lever driving motor, can reliably turn only a relevant page. Thus, a performer can play a musical instrument smoothly with an easy mind.

According to the apparatus of the present invention, load is distributed between the holder driving motor and the lever driving motor. Thus, it is possible to reduce a risk that the driving motors may be overloaded, thereby reducing operational noises and failures. Further, since the top surface of the casing can be covered or exposed to the outside using the cover, it is possible to reduce a risk that foreign materials may be introduced into the casing through the apertures formed in the casing.

Furthermore, according to the apparatus of the present invention, the apparatus can operate without power supply from the outside since the internal power supply unit is provided in the apparatus itself. The internal power supply unit may comprise a disposable dry cell or rechargeable battery. In addition, if an RF signal generator and a signal sensor are additionally provided in the apparatus, the apparatus can be operated in a wireless manner.

What is claimed is:

1. An apparatus for automatically turning a page of a book, comprising:

a casing (10) on which a music book (5) can be placed in an opened state;

a page holding means (40) which is installed within the casing (10) and holds a page (6) of the opened music book (5) to be turned and a turned page (7) thereof and comprises a first holder (42) and a second holder (43) being installed within the casing (10) to come out from or get in the casing (10) through first and second holder apertures (12, 13) formed in a top surface of the casing (10) on both lateral sides of a central portion (8) of the music book (5) and hold the page (6) to be turned and the turned page (7), respectively;

a page turning means (50) for turning a page of the opened music book, comprising an actuating lever (55) which is installed within the casing (10) to come out from or get in the casing (10) through a lever slit (15) formed in a top surface of the casing (10) along the width of the page (6) to be turned from a central portion (8) of the music book (5) and to pivot in a right and left direction on a pivoting shaft (65) adjacent to the central portion (8) of the music book (5);

a driving means (60) for driving the page holding means (40) and the page turning means (50), comprising a pivoting driving portion (61) for causing an actuating lever (55) to pivot so that the actuating lever (55) can come out from or get in the casing (10) through a lever slit (15) formed in a top surface of the casing (10) along the width of the page (6) to be turned from a central portion (8) of the music book (5), the actuating lever (55) being installed within the casing (10) to pivot in a right and left direction on a pivoting shaft (65) and having a contact member (55) coupled to a distal end thereof to come into contact with the page (6) of the music book (5) to be turned, a first holder driving portion (81) for causing a first holder (42) to come into contact with or to be separated from the page (6) to be turned, the first holder (42) coming out from and getting in the casing (10) through a first holder aperture (12) of first and second apertures (12, 13) formed in a top surface of the casing (10) on both lateral sides of a central portion (8) of the music book (5), and a second holder driving portion (101) for causing a second holder (43) to come into contact with or to be separated from the turned page (7), the second holder (43) coming out from and getting in the casing (10) through the second holder aperture (13);

a manipulation means (110) for manipulating operations of the driving means (60); and a control unit (130) for controlling the operations of the driving means (60) for turning a relevant page of the music book (5) placed on the casing (10), in response to signals from the manipulation portion (110).

2. The apparatus as claimed in claim 1, wherein the actuating lever (55) has a contact member (56) coupled to a distal end thereof to come into contact with the page (6) of the music book (5) to be turned.

3. The apparatus as claimed in claim 1, wherein the pivoting driving portion (61) comprises:

a pivoting shaft unit (62) installed at a central portion of the interior of the casing (10) perpendicularly to the length of the actuating lever (55) to cause the actuating lever (55) to pivot in the right and left direction;

a lever driving motor (71) which can rotate in a forward or reverse direction and is disposed adjacent and parallel to the pivoting shaft unit (62); and a power reduction gear unit (73) which is interposed between the lever driving motor (71) and the pivoting shaft unit (62) to reduce the rotation of the lever driving motor (71) and to transmit the reduced rotation to the pivoting shaft unit (62).

4. The apparatus as claimed in claim 3, wherein the pivoting shaft unit (62) comprises:

a bracket (63) formed with shaft holes (64) at opposite sides thereof with the actuating lever (55) interposed therebetween;

the pivoting shaft (65) of which both ends are rotatably fitted into the shaft holes (64) of the bracket (63) and through which an end of the actuating lever (55) penetrates to be pivotably coupled thereto; and a guider (68) which is connected via gears to the power reduction gear unit (73) to rotate about the pivoting shaft (65) and has a guide slot (69) formed to make an acute angle with respect to an axis of the pivoting shaft (65), the actuating lever (55) penetrating though the guide slot (69).

5. The apparatus as claimed in claim 3 or 4, wherein the pivoting driving portion (61) further comprises first and second micro switches (75, 76) provided on opposites sides with respect to the pivoting shaft unit (62) so that the actuating lever (55) can selectively come into contact with the switches upon pivoting of the actuating lever (55), thereby controlling the operation of the lever driving motor (71).

6. The apparatus as claimed in claim 3 or 4, wherein the pivoting driving portion (61) further comprises a leaf spring (79) which is installed between the pivoting shaft unit (62) and the lever driving motor (71) to guide the actuating lever (55) in an aft direction along an axis of the pivoting shaft (65) upon pivoting of the actuating lever (55) in the right and left direction.

7. The apparatus as claimed in claim 1, wherein the first holder driving portion (81) comprises:

a pivoting shaft (82) which is installed longitudinally within the casing (10) to cause the first holder (42) secured perpendicularly thereto to come out from or get in the casing (10) through the first holder aperture (12); and a holder driving motor (85) for rotating the pivoting shaft (82) in a forward or reverse direction.

8. The apparatus as claimed in claim 7, wherein the pivoting shaft (82) comprises:

a first holder shaft (83) to which the first holder (42) is secured;

a driving shaft (84) coupled to the holder driving motor (85); and a torsion spring (86) for connecting the first holder shaft (83) to the driving shaft (84).

9. The apparatus as claimed in claim 8, wherein the pivoting shaft (82) further comprises:

a holder cam (87) and a shaft cam (88) which are installed on the first holder shaft (83) and the driving shaft (84), respectively, to rotate integrally therewith, and have mutually opposite cam profiles; and third and fourth micro switches (77, 78) which are installed within the radii of the cam profiles of the holder cam (87) and the shaft cam (88), respectively, so that the holder cam (87) and the shaft cam (88) selectively come into contact with the third and fourth micro switches (77, 78), thereby controlling the rotation of the holder driving motor (85) in the forward or reverse direction.

10. The apparatus as claimed in claim 1, wherein the second holder driving portion (101) comprises:

a second holder shaft (102) for causing the second holder (43) to come out from or to get in the casing (10) through the second holder aperture (12) of the casing (10);

a spring (105) installed perpendicular to the second holder shaft (102) to elastically urge the second holder shaft (102) so that the second holder shaft (102) can pivot in a direction in which the second holder (43) comes out from the casing through the second holder aperture (12); and an interlocking operation bar (107) attached to an end of the first holder shaft (83) so that the second holder (43) which has come out from the casing (10) through the second holder aperture (13) can get back in the casing (10) while being interlocked with the first holder (42).

11. The apparatus as claimed in claim 1, wherein the second holder driving portion (101) comprises:

a second holder shaft (102) for causing the second holder (43) to pivot such that the second holder (43) can come out from or to get in the casing (10) through the second holder aperture (13) formed perpendicularly to the first holder aperture (12) in the top surface of the casing (10); and bevel gears (142, 143) which are installed on a first holder shaft (83) of the first holder driving portion (81) and on an end of the second holder shaft (102) provided perpendicularly to the first holder shaft (83), respectively, to transmit rotational force of the first holder shaft (83) to the second holder shaft (102).

12. The apparatus as claimed in claim 1, wherein the casing (10) further comprises an actuation switch (144) and a fifth micro switch (145) for controlling the operations of the driving means (60) by sensing whether the music book (5) is placed on the top surface of the casing (10).

13. The apparatus as claimed in claim 1, wherein a cover (30) is pivotably installed on the casing (10) to cause the top surface of the casing (10) to be covered or exposed to the outside, and an inner surface of the cover (30) is provided with a cover holder (31) for partially holding the page (6) to be turned and a cover boss (32) protruding from a portion of the inner surface of the cover (30) adjacent to the cover holder (31) so that the page (6) to be turned can curvedly bulge in a fore direction.

14. The apparatus as claimed in claim 1 or 13, wherein the casing (10) is provided with an external power supply unit (121), and an internal power supply unit (123) that can be selectively used and accommodate a rechargeable battery.

15. The apparatus as claimed in claim 1, wherein the manipulation portion (110) further comprises:

an RF signal generator (115) mounted on a foot switch (118); and an RF signal sensor (117) for sensing RF signals from the RF signal generator (115) and transmitting the sensing results to the control unit (130).

* * * * *